US008033785B2

(12) United States Patent
Thermos et al.

(10) Patent No.: US 8,033,785 B2
(45) Date of Patent: Oct. 11, 2011

(54) FEATURES TO PROPERLY ORIENT INLET GUIDE VANES

(75) Inventors: Anthony Constantine Thermos, Greer, SC (US); Stephen Paul Wassynger, Simpsonville, SC (US); Carlos Alberto Collado, Moore, SC (US); Ajay Gangadhar Patil, Greenville, SC (US); Cj Silver, Stuart, FL (US)

(73) Assignee: General Electric Company, Schenectady, NY (US)

( * ) Notice: Subject to any disclaimer, the term of this patent is extended or adjusted under 35 U.S.C. 154(b) by 621 days.

(21) Appl. No.: 12/209,284

(22) Filed: Sep. 12, 2008

(65) Prior Publication Data

US 2010/0068049 A1 Mar. 18, 2010

(51) Int. Cl.
*F04D 29/56* (2006.01)

(52) U.S. Cl. ..... 415/150; 415/160

(58) Field of Classification Search ..... 415/150, 415/160, 191, 208.2
See application file for complete search history.

(56) References Cited

U.S. PATENT DOCUMENTS

| | | | | |
|---|---|---|---|---|
| 2,567,586 | A | 9/1951 | Werder | |
| 3,996,670 | A | 12/1976 | Joyal et al. | |
| 4,056,888 | A | 11/1977 | Hughey, Jr. | |
| 4,146,967 | A | 4/1979 | Rohner et al. | |
| 4,395,827 | A | 8/1983 | Stowe et al. | |
| 4,411,073 | A | 10/1983 | Ryan | |
| 4,428,126 | A | 1/1984 | Banks | |
| 4,642,901 | A | 2/1987 | Webb | |
| 4,890,977 | A * | 1/1990 | Tremaine et al. | 415/164 |
| 5,031,313 | A * | 7/1991 | Blair et al. | 29/889.1 |
| 5,031,335 | A | 7/1991 | Kimmelman | |
| 5,152,070 | A | 10/1992 | Sorokes | |
| 5,152,071 | A | 10/1992 | Bergeron | |
| 5,492,446 | A * | 2/1996 | Hawkins et al. | 415/160 |
| 5,628,119 | A | 5/1997 | Bingham et al. | |
| 5,630,701 | A * | 5/1997 | Lawer | 415/160 |
| 5,993,160 | A | 11/1999 | Bouchard et al. | |
| 6,039,534 | A * | 3/2000 | Stoner et al. | 415/162 |
| 6,381,908 | B1 | 5/2002 | Fisher | |
| 6,450,763 | B1 * | 9/2002 | Crum et al. | 415/160 |
| 6,457,913 | B1 | 10/2002 | Garten | |
| 6,860,028 | B2 | 3/2005 | Charest et al. | |
| 6,886,267 | B1 | 5/2005 | Karwowski et al. | |
| 6,895,684 | B1 | 5/2005 | Firth | |
| 6,935,041 | B2 | 8/2005 | Orton | |
| 7,152,338 | B2 | 12/2006 | Thompson et al. | |
| 7,185,875 | B1 | 3/2007 | Jarrett | |
| 7,223,066 | B2 * | 5/2007 | Rockley | 415/160 |
| 7,344,355 | B2 * | 3/2008 | Wilshaw | 415/160 |
| 7,478,991 | B2 * | 1/2009 | Noelle | 415/159 |
| 7,571,551 | B1 | 8/2009 | Anderson | |

(Continued)

*Primary Examiner* — George Fourson, III
(74) *Attorney, Agent, or Firm* — Cantor Colburn LLP

(57) ABSTRACT

Several physical features on an inlet guide vane (IGV) ensure proper orientation of the IGV within a compressor during assembly. A gear with several teeth removed results in a flat surface on the gear which inhibits the gear from rotating on the rack of the compressor inlet casing. An orientation pin is located in the internal bore of the gear. The cylindrical IGV spindle has a portion formed as a flat surface and the orientation pin engages this flat surface. These features are applicable to both a one-piece IGV where the jackshaft is integrated with the IGV stem and a two-piece IGV in which the jackshaft is separate from the IGV stem. A feature applicable to a two-piece IGV is a shaped boss on the IGV stem that allows the jackshaft to be located on the IGV stem in only one orientation.

14 Claims, 3 Drawing Sheets

U.S. PATENT DOCUMENTS

2007/0154302 A1* 7/2007 Sconfietti ..... 415/191
2009/0090096 A1* 4/2009 Sheridan ..... 60/226.3
2009/0223073 A1 9/2009 Tu
2010/0068049 A1* 3/2010 Thermos et al. ..... 415/209.3
2010/0092278 A1* 4/2010 Major et al. ..... 415/160
2010/0260591 A1* 10/2010 Martin et al. ..... 415/1
2010/0326041 A1* 12/2010 Edmondson ..... 60/39.093
2010/0329836 A1* 12/2010 Edmondson ..... 415/1

* cited by examiner

FEATURES TO PROPERLY ORIENT INLET GUIDE VANES

BACKGROUND OF THE INVENTION

The subject matter disclosed herein relates to gas turbine engines and, more particularly, to various physical features on an inlet guide vane (IGV) that facilitate the proper orientation of the IGV within the compressor, thereby eliminating the chance of backwards installation of the IGV.

It is known to install an IGV in an improper, backwards configuration within a compressor of a gas turbine engine. As a result of the backwards installation, not only can performance issues occur but also structural issues may arise on the forward rotor and stator blades and vanes within the compressor. Worst case, an expensive failure of the compressor may occur.

BRIEF DESCRIPTION OF THE INVENTION

According to one aspect of the invention, several physical features on an inlet guide vane (IGV) ensure proper orientation of the IGV within a compressor during assembly. A gear with several teeth removed results in a flat surface on the gear which inhibits the gear from rotating on the rack of the compressor inlet casing. An orientation pin is located in the internal bore of the gear. The cylindrical IGV spindle has a portion formed as a flat surface and the orientation pin engages this flat surface. These features are applicable to both a one-piece IGV where the jackshaft is integrated with the IGV stem and a two-piece IGV in which the jackshaft is separate from the IGV stem. A feature applicable to a two-piece IGV is a shaped boss on the IGV stem that allows the jackshaft to be located on the IGV stem in only one orientation.

These and other advantages and features will become more apparent from the following description taken in conjunction with the drawings.

BRIEF DESCRIPTION OF THE DRAWING

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
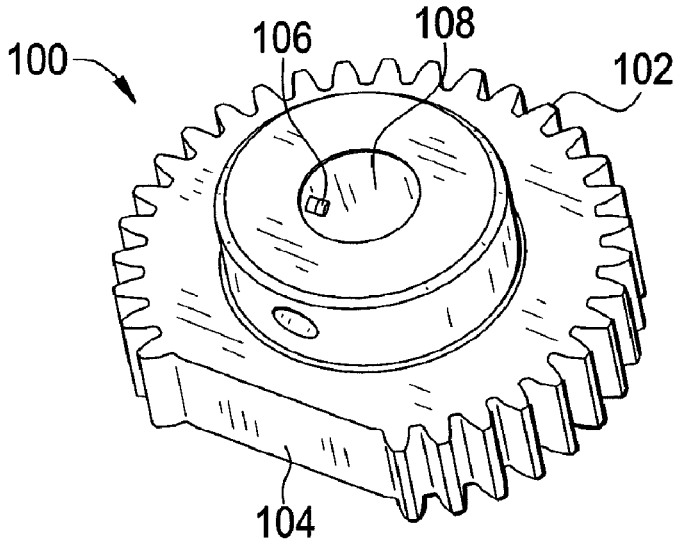
FIG. 1 is a perspective view of a gear according to an embodiment of the invention.

Referring to FIG. 1, there illustrated is a gear 100 according to an embodiment of the invention, having a number of teeth 102. A portion of the gear 100 has no teeth 102, resulting in a flat surface 104. An orientation pin 106 is provided and is positioned by press fit, such that the pin protrudes into the internal bore 108 of the gear 100 at a predefined distance.

Figure 2:
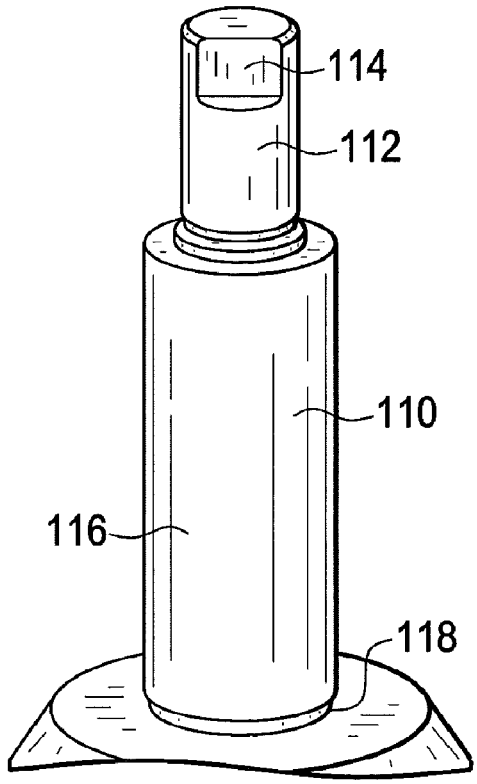
FIG. 2 is a perspective view of an IGV spindle according to an embodiment of the invention.

Referring to FIG. 2, there illustrated is an IGV spindle 110 according to an embodiment of the invention. An upper portion 112 of the spindle 110 is cylindrical except for a flat surface 114 formed therein. The IGV spindle 110 illustrated in FIG. 2 is a one-piece spindle (i.e., the jackshaft 116 is formed integral with the IGV stem 118). The gear 100 having a flat portion 104, along with the orientation pin 106 and the flat surface 114 in the upper portion 112 of the spindle 110 comprise the "foolproof" mechanical features of an embodiment of the invention for enduring that the IGV is oriented properly and not backwards during assembly. These features may be used on a one-piece IGV spindle or a two-piece IGV spindle in which the jackshaft 116 is separate from the IGV stem 118 and the jackshaft 116 typically connects to the IGV stem 118 through use of conical surfaces in a known manner.

Figure 3:
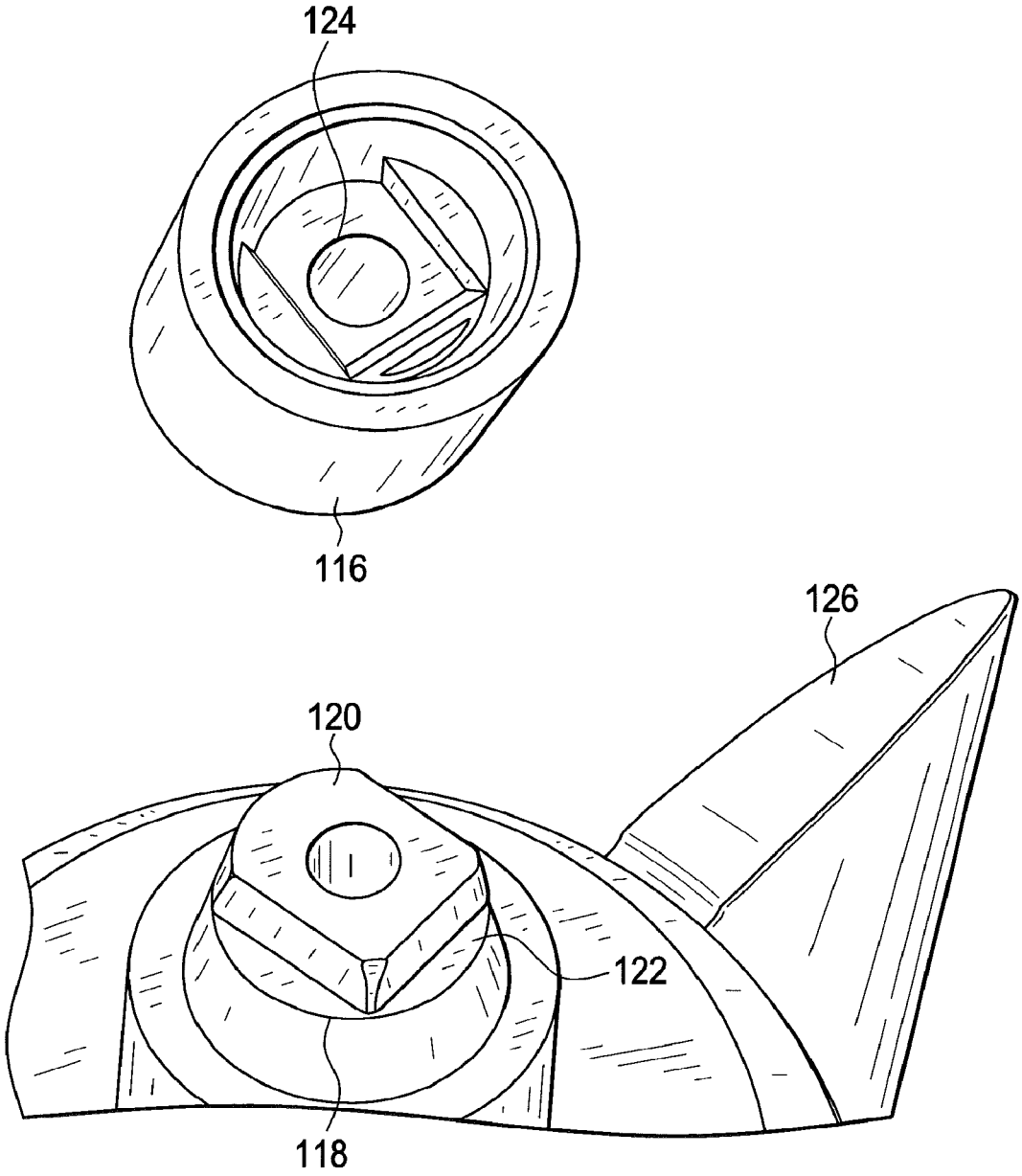
FIG. 3 is a perspective view of a bottom portion of an IGV jackshaft and a corresponding IGV stem according to an embodiment of the invention.

Referring to FIG. 3, there illustrated is a bottom portion of an IGV jackshaft 116 along with a corresponding IGV stem 118 that connect together in a "foolproof" manner according to an embodiment of the invention. The IGV stem 118 has a "D" shaped boss 120 formed on an upper portion 122 of the IGV stem 118. In turn, the inside of the bottom portion of the IGV jackshaft 116 has a "D" shaped receptacle 124 formed therein. When the jackshaft 116 is assembled with the IGV stem 118, the "D" shaped boss 120 and receptacle 124 allow for proper orientation of the jackshaft 116 on the stem 118 to occur in only one orientation, where such orientation may be determined by the location of the IGV blade leading edge 126. While a "D" shaped boss 120 and receptacle 124 have been described and illustrated herein, other shapes for the boss 120 and the receptacle are contemplated by embodiments of the invention.

Figure 4:
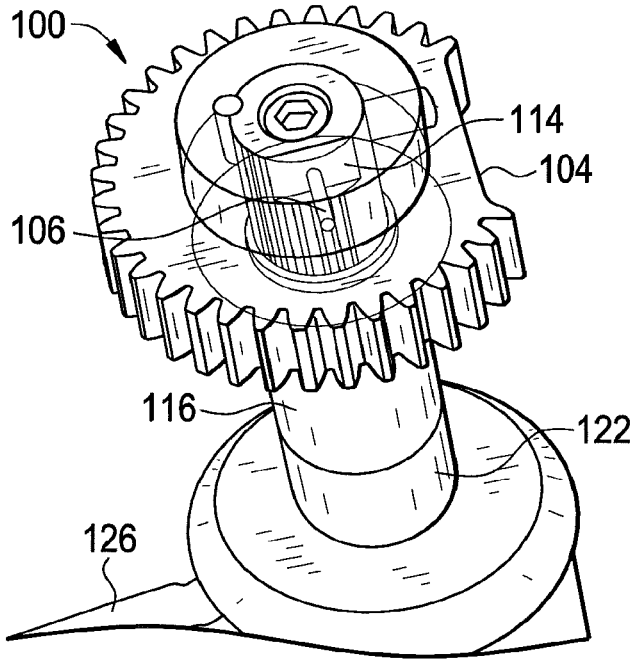
FIG. 4 illustrates the gear of FIG. 1 and the jackshaft of FIG. 3 assembled together for an embodiment of the invention.
Figure 5:
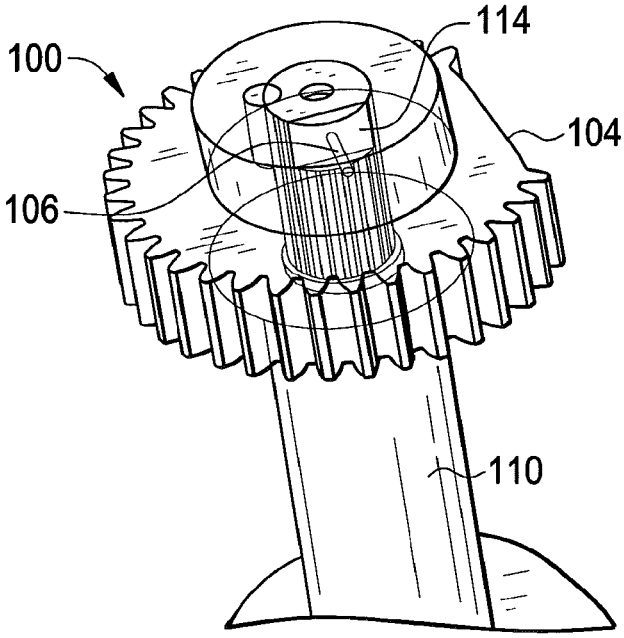
FIG. 5 illustrates the gear of FIG. 1 and the spindle of FIG. 2 assembled together for another embodiment of the invention.

Referring to FIG. 4, there illustrated is the gear 100 of FIG. 1 and the jackshaft 116 of FIG. 3 assembled together in an embodiment of the invention in which the jackshaft 116 is separate from the IGV stem 118 (i.e., the "two-piece" IGV). FIG. 5 illustrates the gear 100 of FIG. 1 and the spindle 110 of FIG. 2 assembled together in another embodiment of the invention in which the jackshaft 116 is formed integral with the IGV (i.e., the "one-piece" IGV). In either embodiment, the gear 100 is placed on the IGV spindle 110 such that the orientation pin 106 is positioned at a predetermined distance from the flat portion 114 of the IGV spindle 110. As can be seen in FIG. 4, the flat surface 104 of the gear 100 is located opposite the leading edge 126 of the IGV vane. This is typically the desired orientation of the IGV with respect to the geared rack (not shown) that meshes with the gear 100 and on which the gear 100 travels to adjust the position of the IGV, for example, to adjust the aerodynamic performance characteristics of the compressor of the gas turbine engine.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An inlet guide vane (IGV), comprising:

a jackshaft having a spindle, the spindle being cylindrical in shape for a portion of a circumference of the spindle and having a flat portion over another portion of the circumference of the spindle;

a gear having a number of teeth and a flat portion devoid of any teeth; and an orientation pin located through a wall of the gear and configured to be positioned into the internal bore of the gear, at a predetermined distance from the flat portion of the spindle.

2. The inlet guide vane of claim 1, further comprising an IGV stem.

3. The inlet guide vane of claim 2, the jackshaft being formed integral with the IGV stem.

4. The inlet guide vane of claim 2, the jackshaft being formed separate from the IGV stem.

5. The inlet guide vane of claim 4, the IGV stem including a boss having a predetermined shape and being formed on an upper portion of the IGV stem, and a bottom of the jackshaft having a receptacle to receive the boss and thereby orient the IGV stem and the jackshaft in a single position and inhibiting any other position between the IGV stem and the jackshaft.

6. The inlet guide vane of claim 4, the boss and the receptacle being both "D" shaped.

7. An inlet guide vane (IGV), comprising:

a spindle cylindrical in shape for a portion of a circumference of the spindle and having a flat portion over another portion of the circumference of the spindle;

a gear having a number of teeth and a flat portion devoid of any teeth; and an orientation pin located through a wall of the gear and configured to be positioned into the internal bore of the gear, at a predetermined distance from the flat portion of the spindle.

8. An inlet guide vane (IGV), comprising:

a jackshaft having a spindle with a flat surface over a portion of the spindle;

a gear having a number of teeth and a flat portion devoid of any teeth; and an orientation pin located through a wall of the gear and configured to be positioned into the internal bore of the gear, at a predetermined distance from the flat portion of the spindle.

9. The inlet guide vane of claim 8, further comprising an IGV stem.

10. The inlet guide vane of claim 9, the jackshaft being formed integral with the IGV stem.

11. The inlet guide vane of claim 9, the jackshaft being formed separate from the IGV stem.

12. The inlet guide vane of claim 11, the IGV stem including a boss having a predetermined shape and being formed on an upper portion of the IGV stem, and a bottom of the jackshaft having a receptacle to receive the boss and thereby orient the IGV stem and the jackshaft in a single position and inhibiting any other position between the IGV stem and the jackshaft.

13. The inlet guide vane of claim 12, the boss and the receptacle being both "D" shaped.

14. The inlet guide vane of claim 8, the orientation pin being threaded through the wall of the gear.

* * * * *